US009950231B2

(12) United States Patent
Bulloch

(10) Patent No.: US 9,950,231 B2
(45) Date of Patent: Apr. 24, 2018

(54) HOCKEY SKILLS TRAINING SYSTEM AND METHOD OF USING THE SAME

(71) Applicant: Courtney John Bulloch, Johnston, IA (US)

(72) Inventor: Courtney John Bulloch, Johnston, IA (US)

( * ) Notice: Subject to any disclaimer, the term of this patent is extended or adjusted under 35 U.S.C. 154(b) by 0 days.

(21) Appl. No.: 15/054,902

(22) Filed: Feb. 26, 2016

(65) Prior Publication Data

US 2016/0250538 A1 Sep. 1, 2016

Related U.S. Application Data

(60) Provisional application No. 62/126,060, filed on Feb. 27, 2015.

(51) Int. Cl.
*A63B 69/00* (2006.01)
*A63B 63/00* (2006.01)

(52) U.S. Cl.
CPC ..... *A63B 69/0026* (2013.01); *A63B 63/004* (2013.01); *A63B 2210/50* (2013.01)

(58) Field of Classification Search
CPC .. A63B 63/004; A63B 63/005; A63B 69/0026
USPC ..... 273/398–402; 472/90, 92; 473/446, 478
See application file for complete search history.

(56) References Cited

U.S. PATENT DOCUMENTS 3,765,675 A * 10/1973 DiMarzio ..... A63B 63/06 273/126 A
3,856,298 A * 12/1974 Frantti ..... A63B 63/00 273/127 R
4,607,842 A * 8/1986 Daoust ..... A63B 24/0021 124/51.1
4,948,147 A * 8/1990 Pallanca ..... A63B 63/00 273/396
5,249,797 A * 10/1993 Dowhy ..... A63B 24/0021 473/155
5,509,652 A * 4/1996 Woronets ..... A63B 69/36 473/446
6,059,673 A * 5/2000 Mason ..... A63B 63/00 473/415
6,364,790 B1 * 4/2002 Carrie ..... A63B 69/00 473/278
7,104,901 B1 * 9/2006 Mason ..... A63B 5/16 473/446
7,160,214 B1 * 1/2007 Rome ..... A63B 71/022 273/348
7,166,045 B1 * 1/2007 Linner ..... A63B 24/0003 446/422
7,235,025 B2 * 6/2007 Quinn ..... A63B 24/0021 273/127 R
7,244,199 B1 * 7/2007 Romano ..... A63B 71/022 273/127 R
8,469,841 B1 * 6/2013 Giauque ..... A63B 69/0026 473/164
2004/0142775 A1 * 7/2004 Nudo ..... A63B 47/002 473/446
2010/0137079 A1 * 6/2010 Burke ..... A63B 24/0003 473/446

(Continued)

*Primary Examiner* — Mark Graham
(74) *Attorney, Agent, or Firm* — Carson LLP

(57) ABSTRACT

A hockey skills training system comprising a high density polymer game board surface; a pair of nested goals disposed on one side of the shooting surface; a handle attached to the shooting surface; and at least one puck.

10 Claims, 5 Drawing Sheets

(56) References Cited

U.S. PATENT DOCUMENTS

| | | | | |
|---|---|---|---|---|
| 2014/0256476 | A1* | 9/2014 | Sallinen | A63B 69/0026 473/446 |
| 2015/0196819 | A1* | 7/2015 | Markham | A63B 71/0622 473/446 |
| 2015/0297967 | A1* | 10/2015 | Simon | A63B 69/0026 473/446 |

* cited by examiner

HOCKEY SKILLS TRAINING SYSTEM AND METHOD OF USING THE SAME

CROSS REFERENCE TO RELATED APPLICATIONS

The present non-provisional application claims priority to provisional patent application 62/126,060, filed Feb. 27, 2015.

BACKGROUND

1. Field of the Art

The present invention relates generally to athletic gaming and training devices, systems and methods. More specifically, the present invention relates to a training system comprising a physical game and method of playing the game whereby athletic skills, specifically hockey skills, are developed.

2. Description of the Prior Art

The ability to pass a hockey puck to another player so that it flies through the air like a toy flying saucer for toss games, e.g., a FRISBEE®, over opposing players while still landing flat on the ice for a teammate to control is a very useful hockey skill commonly referred to as "saucing", This type of pass (a "sauce") is usually executed when a defensive player tries to get his/her stick in between an offensive player with the puck and the offensive player's teammate across ice.

To execute this type of pass, a player "opens" the blade of his/her hockey stick (like a golf wedge) so that the puck is positioned at the heel of the blade. With a very slight wrist action, the puck is swept across the blade to drive the puck into the air. Developing a good pass technique requires a lot of practice, and the present invention is a useful aid in developing this skill.

SUMMARY

In one exemplary embodiment, the present invention comprises a hockey skills training system, said system comprising a hard low friction polymer surface; a goal frame disposed at one end of said surface, said goal frame comprising a semi-rigid arch member extending across the end of said surface; a second goal frame, said second goal frame disposed across the end of said surface within said first goal frame; and goal netting disposed over said first goal frame and said second goal frame.

In another exemplary embodiment, the present invention comprises a hockey skills training system, said system comprising: a high density polymer board defining a planar surface; and a pair of nested goals disposed at one end of said planar surface, each goal respectively including removable netting attached to a goal frame.

In another exemplary embodiment, the present invention comprises a method of playing a hockey skills training game, said method comprising the steps of providing a pair of game boards; placing each one of said game boards a predetermined distance apart from one another; placing a plurality of pucks on one game board; providing a pair of teams, each team comprising at least one player; placing a team at each board; alternating turns between each team to allow at least one member of each team to shoot at least one puck from one board towards the opposing goal on the other board; and keeping track of the number of successful attempts by each team to deliver a puck into the goal of the other board.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DETAILED DESCRIPTION OF THE EMBODIMENTS

The present invention will be discussed hereinafter in detail in terms of various exemplary embodiments according to the present invention with reference to the accompanying drawings. In the following detailed description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscuring of the present invention.

Thus, all of the implementations described below are exemplary implementations provided to enable persons skilled in the art to make or use the embodiments of the disclosure and are not intended to limit the scope of the disclosure, which is defined by the claims. As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "upper". "lower", "left", "rear", "right", "front", "vertical", "horizontal", and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
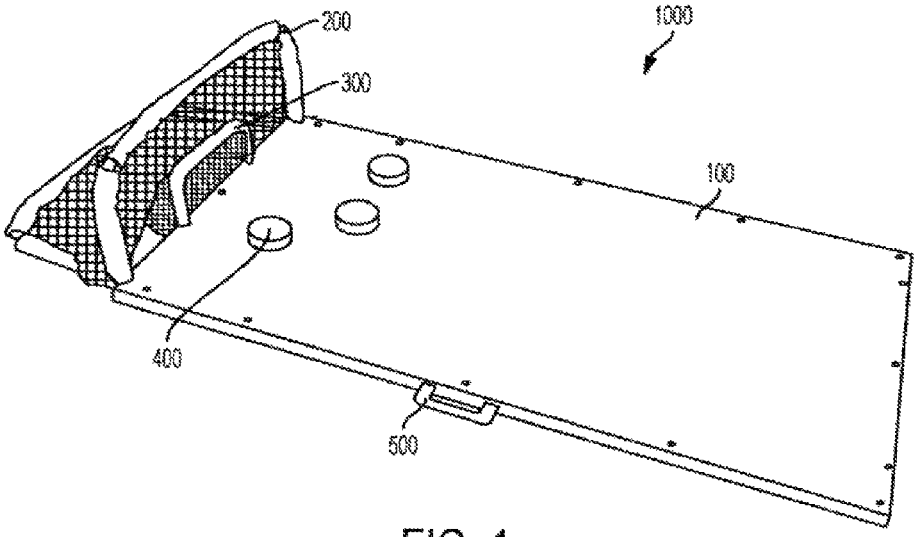
FIG. 1 shows a perspective view of a system in accordance with the present invention.

Referring first to FIG. 1, hockey skills training system 1000 comprises at least one playing surface/game board 100. Each board 100 is preferably 24"×42" with machined sockets for placement of nested goals 200 and 300 at one end. Board 100 comprises a hard low friction planar surface such as high density polyethylene ("HOPE") surface, and is attached with 30 zinc plated countersunk screws to an extruded aluminum channel frame with HOPE plastic gussets in each corner. The aluminum channel has an annodized finish to protect the unit from rusting.

Figure 2:
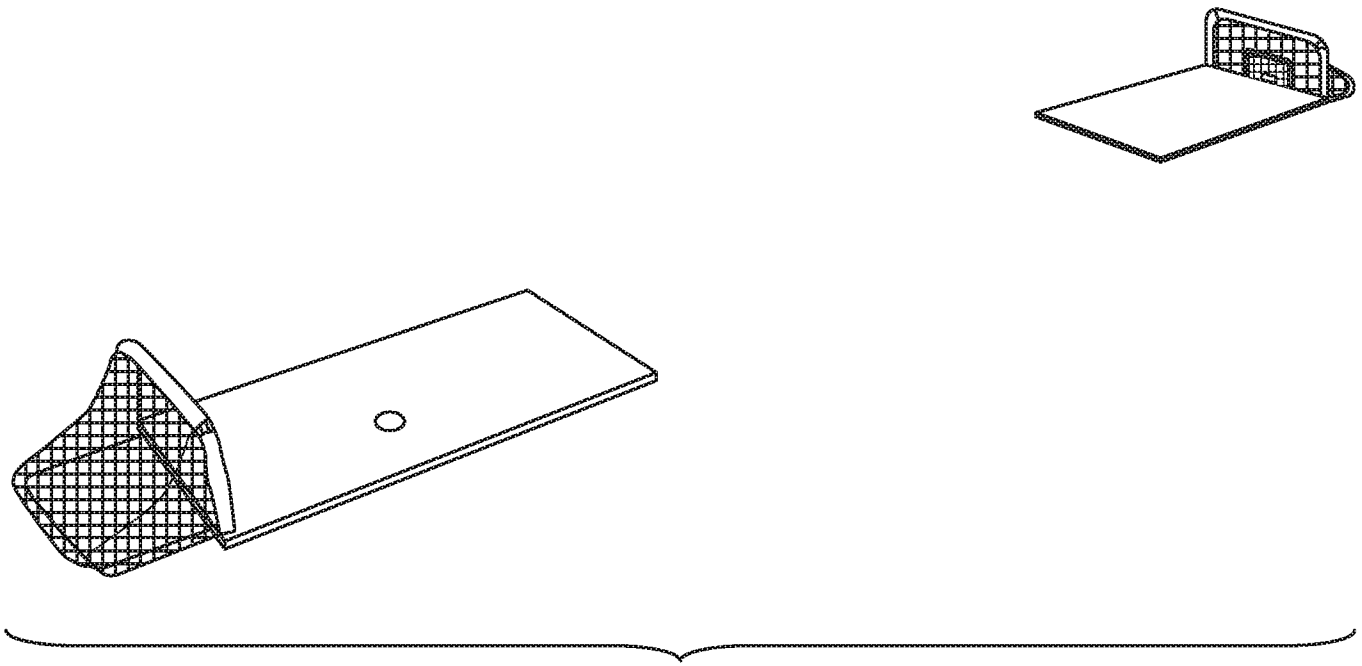
FIG. 2 shows a perspective view of a system arranged to perform the method of the present invention.
Figure 3:
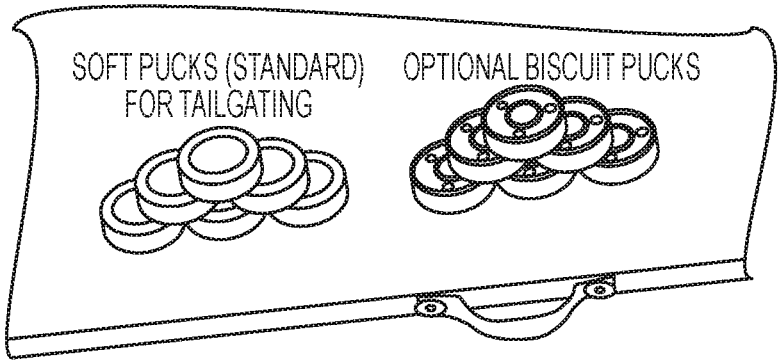
FIG. 3 shows an embodiment of game pieces for use with the present invention.

Each goal 200 and 300 fits onto the board at its rear end and as shown in FIG. 1, planar board surface and the respective frame define the opening of the large or small goal 200, 300. Large goal 200 is 23½" wide by 12" high and is disposed at one end of board 100. The small goal 300 is 5" high by 9" wide and is nested within large goal 200. Goals 200 and 300 are fixedly attached to one end of board 100. Both goals 200 and 300 include frames of steel that are covered with marine grade vinyl trim encapsulating edges of the netting, which is a square, industrial grade ¾" high tenacity polypropylene ("HTPP") knotless net. Steel piping extends through the trim along the back of the large goal net (FIG. 1) and holds the netting snug to the ground, containing even hard passes. Small goal net 300 is designed to create a pocket for high scoring shots within the game, and according to one embodiment the netting is attached via hook and loop fasteners to the small goal frame to create a pocket. The design of each goal is such that one simply picks up the back of each net to retrieve pucks for each turn. As shown in FIGS. 1 and 2, the entirety of space within the respective net of the large or small goal 200, 300 is substantially rearward of its board 100. Pucks 400 may comprise a soft vinyl puck, or an optional, harder, standard biscuit puck (FIG. 3).

Figure 4:
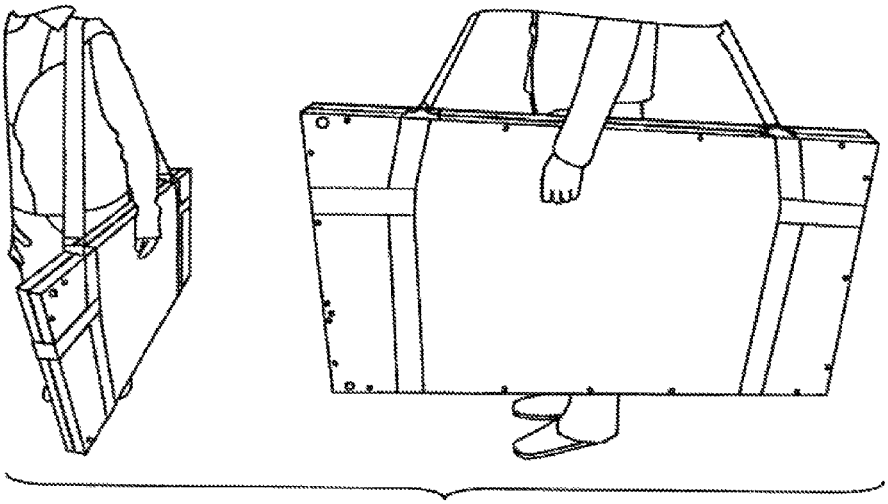
FIG. 4 shows an embodiment of the system of the present invention adapted for transport.
Figure 5:
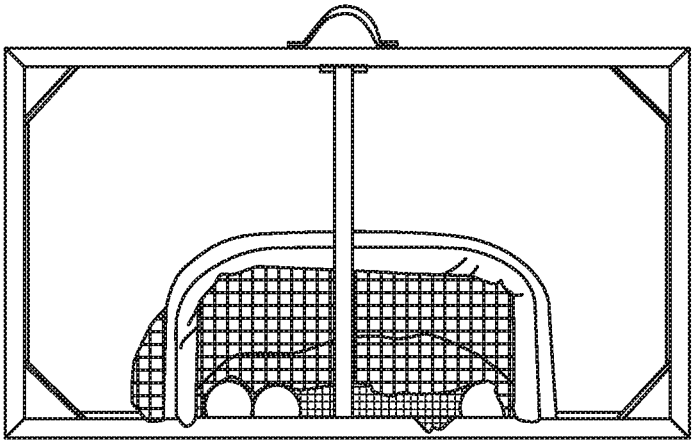
FIG. 5 shows a bottom plan view of the embodiment shown in FIG. 4 with netting and pucks stored inside.

The underside of each board 100 is open and the goals 200, 300 are detachable from their respective boards 100. Goals 200, 300 may be contained within the interior of its board for storage and/or transport, as shown in FIG. 5. Referring to FIG. 4, the pair of boards 100 may be stacked such that their undersides interface and their edges align, thereby enclosing the space defined by the board interiors and housing the goals and pucks contained therein. Boards 100 may be retained in their stacked configuration and carried using a strap fitted thereabout, as shown in FIG. 4.

In one exemplary embodiment, hockey skills training system 1000 comprises two boards 100, each with goals 200 and 300 and a handle 500, and pucks 400 (FIG. 2), one board 100 used as a "shooting pad," with its planar surface defining a shooting surface, and the other board 100 used as a "receiving pad," with its planar surface defining a receiving surface.

A method of using such an exemplary embodiment comprises arranging the two boards 100 as shown in FIG. 2, preferably 24 feet apart. The distance is measured from the front end of one board 100 to the front end of the other board 100. Those of ordinary skill in the art will appreciate that other distances may be used. A game according to the exemplary method is preferably played with two teams. Each team preferably comprises two players with three pucks 400 of a distinguished color for each team. One player from each team takes position on opposing boards 100 and all pucks 400 are started from one side, on the initial shooting pad.

Figure 6:
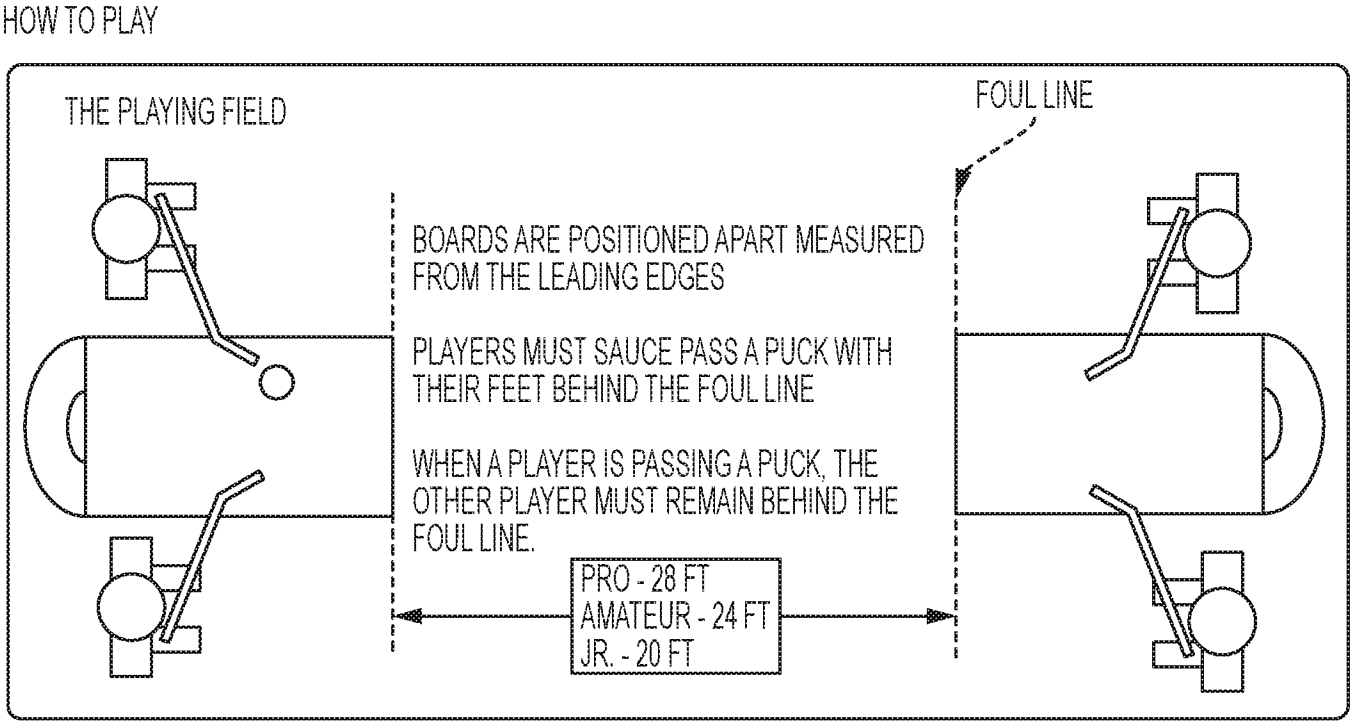
FIG. 6 shows a diagram of a method of using the present invention.

Referring now to FIG. 6, the foul line is defined as the front end of the board. A player shall not cross the foul line before the puck is released. Violation will result in no points for the foul puck, and the puck is to be removed from play before any more pucks are sauced. Pucks already on the receiving surface board that have been knocked off the receiving surface board by a foul puck will be returned to the same location on the receiving surface board. Additionally, pucks that are on the receiving surface board, but are knocked into the net of a goal by a foul puck must be returned to their original location on the receiving surface board.

Pucks that bounce off the ground and come to rest on the receiving surface board or in the net, do not count, and shall be removed from play before any more pucks are sauced. Again, if other pucks are contacted, the same rules as above apply. Pucks that come to rest on the receiving surface board, but are hanging over the edge of the receiving surface board and touching the ground or grass, do not count, and shall be removed from play before any more pucks are passed.

The team listed on top in the tournament bracket shall begin play first. Each player sauces all of his or her respective pucks by alternating turns with the opposing player. The round is complete after all six pucks are sauced. The points are awarded as follows: Three (3) points for each puck delivered into the small goal net; and one (1) point for each puck delivered into the large goal net.

A puck must go completely in the net to count for three (3) points. According to one embodiment, any puck(s) that is partially in the net and partially on the board counts as one (1) point. The score for each round is determined by each team combining their points for all pucks in the net with all pucks on the board. The team with the higher total subtracts the opposing team's points and earns the points of the difference between the two totals. The team with the lower total does not earn any points for the round. The team that scores more points for the round goes first in the next round. If there is a tie, the team that went first in the previous round shall go first in the next round. No movements or actions that cause distractions to opposing players are allowed. A tournament official shall resolve any discrepancies or rulings that cannot be resolved mutually between two teams. The winner is declared once a team reaches or exceeds 21 points after the completion of a round.

The boards of the present invention work best on a flat surface. The user(s) should ensure that each board is stable and not rocking during play. It is best that each board is kept dry and clean, with minimum exposure to UV.

The above-described embodiments are merely exemplary illustrations set forth for a clear understanding of the principles of the invention. Many variations, combinations, modifications, or equivalents may be substituted for elements thereof without departing from the scope of the invention. It should be understood, therefore, that the above description is of an exemplary embodiment of the invention and included for illustrative purposes only. The description of the exemplary embodiment is not meant to be limiting of the invention. A person of ordinary skill in the field of the invention or the relevant technical art will understand that variations of the invention are included within the scope of the claims.

The invention claimed is:

1. A system for hockey skills training, said system comprising:

a pair of separable high density polymer game boards, each game board defining a respective playing surface extending between opposite front and rear ends of the game board;

a pair of nested first and second goals disposed at the rear end of each game board, the first goal having a first opening entered from the playing surface, the second goal having a second opening entered from the playing surface, each goal comprising netting extending rearwardly of the respective game board; and at least one puck receivable into a first or second goal through the respective first or second opening;

wherein each first goal comprises an arcuate first member extending between opposite ends thereof at which the first member is attachable to a game board; and wherein each second goal comprises a second member extending between opposite ends thereof at which the second member is attachable to the respective game board, the second member and the playing surface defining the second opening.

2. The system of claim 1, wherein each first goal comprises netting attached to the first member, the netting defining a first puck-receiving space;

wherein each second goal comprises netting attached to the second member, the netting defining a second puck-receiving space; and wherein the entireties of the first and second puck-receiving spaces are located substantially rearwardly of the respective game board rear end.

3. The system of claim 2, wherein the entirety of the second puck-receiving space is located substantially within the first puck-receiving space.

4. The system of claim 1, wherein the first goal comprises netting attached to the first member, the netting defining a first puck-receiving space, and a piping member attached to the netting, the piping member adapted to place a portion of the netting in a ground-engaging position whereby a ground surface defines the first puck-receiving space.

5. The system of claim 1, wherein the second opening, the playing surface and the first member define the first opening.

6. A system for hockey skills training, said system comprising:

a pair of separable high density polymer game boards, each game board defining a respective playing surface extending between opposite front and rear ends of the game board;

a pair of nested first and second goals disposed at the rear end of each game board, the first goal having a first opening entered from the playing surface, the second goal having a second opening entered from the playing surface, each goal comprising netting extending rearwardly of the respective game board; and at least one puck receivable into a first or second goal through the respective first or second opening;

wherein the first and second goals are detachable from the game boards and each game board defines an interior space receivable of the first and second goals, whereby the detached goals are storable in the interior space.

7. A hockey skills training system comprising:

a board defining a hard low friction polymer playing surface extending between longitudinally opposite front and rear ends of the board;

a first goal disposed at the rear end of said board, the first goal comprising a semi-rigid arch member extending laterally across the playing surface; and a second goal comprising a member extending laterally across the playing surface and nested within the first goal, the first and second goals removably attached to the board;

wherein the first goal arch member comprises a first member extending between opposite ends thereof at which the first member is attachable to the board, the first member and the playing surface defining a first goal opening; and wherein the second goal member comprises a second member extending between opposite ends thereof at which the second member is attachable to the board, the second member and the playing surface defining a second goal opening.

8. The system of claim 7, wherein the first goal comprises netting attached to the first member, the netting defining a first puck-receiving space; and wherein the second goal comprises netting attached to the second member, the netting defining a second puck-receiving space.

9. The system of claim 8, wherein the entireties of the first and second puck-receiving spaces are located substantially rearwardly of the board rear end.

10. The system of claim 8, wherein the entirety of the second puck-receiving space is located substantially within the first puck-receiving space.

* * * * *